United States Patent [19]

Wu et al.

[11] 4,228,118

[45] Oct. 14, 1980

[54] PROCESS FOR PRODUCING HIGH TENACITY POLYETHYLENE FIBERS

[75] Inventors: Wen-Li Wu; William B. Black, both of Pensacola, Fla.

[73] Assignee: Monsanto Company, St. Louis, Mo.

[21] Appl. No.: 848,168

[22] Filed: Nov. 3, 1977

[51] Int. Cl.[3] ..... D01D 5/12

[52] U.S. Cl. ..... 264/210.8; 264/176 F; 264/290.5

[58] Field of Search ..... 264/176 F, 210.8, 290.5

[56] References Cited

U.S. PATENT DOCUMENTS

| | | | |
|---|---|---|---|
| 3,078,139 | 2/1963 | Brown et al. | 264/210 F |
| 3,361,859 | 1/1968 | Cenzato | 264/210 F |
| 3,962,205 | 6/1976 | Ward et al. | 264/289 |

FOREIGN PATENT DOCUMENTS

| | | | |
|---|---|---|---|
| 275863 | 2/1964 | Australia | 264/176 F |
| 2447322 | 4/1975 | Fed. Rep. of Germany | 264/210 F |
| 2650747 | 5/1977 | Fed. Rep. of Germany | 264/210 F |
| 2509557 | 11/1977 | Fed. Rep. of Germany | 264/210 F |
| 37-9765 | 7/1962 | Japan | 264/211 |
| 39-12859 | 7/1964 | Japan | 264/178 F |
| 40-1813 | 2/1965 | Japan | 264/290 |
| 41-2735 | 2/1966 | Japan | 264/176 F |
| 1498628 | 1/1978 | United Kingdom | 264/210 F |

OTHER PUBLICATIONS

Baranov et al., Fizika Tyerdogo Tela., (Leningrad), 17 (5), 1550–1552 (1975), trans.

Capaccio et al., Polymer, 1974, vol. 15, pp. 233–238, Apr. 1974.

Meinel et al., J. of Polym. Sci., A-2, 9, 67–83, 1971.

"Influence of Extrusion Ratio on the Tensile Properties of PE", Kojima et al., J. of Polym. Scie. Polym. Physic., vol. 16, pp. 1729–1737 (1978).

Perkins et al., Polymer Engin. & Science, Mar. 1976, vol. 16, No. 3, pp. 200–203.

Capiati et al., J. of Polym. Science, Polymer Phisics Ed., vol. 13, 1177;14 1186 (1975).

"Relationships Between Structural Pargim. and Tenacity of PP Monotils", Sheehan et al. Textile Kes J. pp. 626–637, Jul. 1965.

*Primary Examiner*—Jay H. Woo

*Attorney, Agent, or Firm*—John W. Whisler

[57] ABSTRACT

Polyethylene yarns having tenacities of at least 12 grams per denier are produced at commercially feasible spinning speeds by a process in which a high density polyethylene having a $\overline{M}_n$ of at least 20,000 and a $\overline{M}_w$ of less than 125,000 is extruded through a high temperature spinneret (220°–335° C.) to form yarns which are hot-drawn at a temperature between about 115° and 132° C. The yarns produced by this process are particularly useful as industrial cordage.

15 Claims, No Drawings

PROCESS FOR PRODUCING HIGH TENACITY POLYETHYLENE FIBERS

BACKGROUND OF THE INVENTION

A. Field of the Invention

This invention relates to high density polyethylene yarns having a tenacity of at least 12 grams per denier (gpd) and to a process for producing the same at commercially attractive spinning speeds. The term "spinning speed" as used herein means the velocity in meters per minute (m/min.) of freshly extruded fibers, that is, the velocity of the solidified molten polymer in fiber form before it is drawn. The polyethylenes from which the fibers are extruded are high density polyethylenes having a number average molecular weight ($\bar{M}_n$) of at least 20,000 and a weight average molecular weight ($\bar{M}_w$) less than 125,000. The term "high density polyethylene" is used herein in accordance with conventional terminology and means substantially linear polyethylene having a density of from 0.92 to 1.0 g/cm$^3$. The term "fiber" as used herein means a single filament or a yarn, that is, a bundle of filaments.

B. Description of the Prior Art

Polypropylene, nylon 6 and nylon 66 fibers are widely used in industry as cordage, for example, rope. Industrial cordage fibers normally have a tenacity ranging from about 6 to about 10 gpd and are commonly referred to as high tenacity fibers. There has been a continuing demand in the cordage industry to provide a lower cost high tenacity fiber suitable for cordage end uses. It is envisioned that such a fiber must meet three criteria in order to be competitive with the fibers presently used as cordage. First, the fiber must be produced from a fiber-forming material which is less expensive than polypropylene, nylon 6 or nylon 66. Secondly, the fiber must have a tenacity at least as high as the fibers presently used as industrial cordage and, preferably, a tenacity of at least 12 gpd. Lastly, the fiber must be capable of being produced at reasonably attractive spinning speeds. While it is generally recognized that polyethylene meets the first criterion, heretofore, it has not been possible to produce polyethylene fibers having a tenacity of at least 12 gpd at reasonable spinning speeds.

Most of the work that has been done to date and reported in the literature on polyethylene fibers is directed to processes for producing high modulus polyethylene fibers as a low cost substitute for glass and graphite fibers, which fibers have been traditionally used as the reinforcing material in composites. Such a process is described in U.S. Pat. No. 3,962,205 and West German Pat. No. 2,650,747. The process involves extruding a high density polyethylene of a specified weight average molecular weight (i.e. $\bar{M}_w$) and number average molecular weight (i.e. $\bar{M}_n$) to form fibers which are cooled to a temperature of from 100° to 120° C. at the rate of from 1° to 15° C. per minute and then rapidly cooled. The fiber is then drawn at a temperature at least 40° C. below its melting point at a draw ratio of at least 18. This process however apparently must be operated at very slow spinning speeds due in part at least to the the slow cooling step; for example, in the patents a spinning speed of only about 4–5 meters per minute (m/min.) is illustrated. Moreover, applicants have been unable to produce high tenacity fibers (i.e. yarns having a tenacity of 12 gpd or higher) from the particular polyethylenes specified in the U.S. patent even under conditions which would normally maximize tenacity.

The German patent differs from the U.S. patent in that it extends the useful polyethylenes to include those having a $\bar{M}_w$ greater than 200,000 (e.g. 310,000 to 1,000,000), whereas the U.S. patent specified only those polyethylenes having a $\bar{M}_w$ less than 200,000 and a $\bar{M}_w$ less than 20,000. However, since the melt viscosity of a polyethylene is directly proportional to its $\bar{M}_w$, fibers of the high $\bar{M}_w$ polyethylenes disclosed in the German patent cannot be produced at commercially feasible spinning speeds by presently known means.

Therefore, it is an object of the present invention to provide polyethylene yarns having a tenacity of at least 12 gpd and a process for producing the same at commercially feasible spinning speeds.

Other objects and advantages of the invention will become apparent from the following detailed description thereof.

SUMMARY OF THE INVENTION

In accordance with the foregoing objects, the present invention provides polyethylene yarns having a tenacity of at least 12 gpd. The invention also provides a process for producing such yarns or a single filament at commercially feasible spinning speeds, that is, at spinning speeds of at least 30 m/min. and, preferably, at least 50 m/min. The process comprises:

(1) extruding a high density polyethylene having a $\bar{M}_n$ of at least 20,000 and a $\bar{M}_w$ of less than 125,000 through a heated spinnert having at least one orifice to provide at least one molten stream, wherein said heated spinneret is maintained at a temperature between about 220° and 335° C.;

(2) solidifying each said molten stream in a quenching zone to form a fiber;

(3) withdrawing said fiber from said quenching zone at a velocity (i.e. spinning speed) of at least 30 m/min., and then (4) hot-drawing said fiber at a given draw ratio while said fiber is in contact with a heated environment, wherein said heated environment is maintained at a temperature between 115° and 132° C., said temperatures, said velocity, and said draw ratio being correlated to provide a fiber having a tenacity of at least 12 gpd. The hot-drawing step may be accomplished inline (i.e. without take-up of the spun fiber) or the spun fiber may be taken-up and subsequently hot-drawn in a separate operation. The process may be employed to provide a monofilament or a yarn (bundle of filaments).

The process of the present invention is carried out under conditions which have been found by applicants to maximize the tenacities of polyethylene fibers. First, it is essential that the polyethylenes from which the fibers are produced have a $\bar{M}_n$ of at least 20,000 and a density of at least 0.92 g/cm$^3$ and preferably at least 0.96 g/cm$^3$. Secondly, it is also essential that the spinneret used in producing the fibers be maintained at a temperature between about 220° and about 335° C. Thirdly, the fibers must be hot-drawn at a temperature between 115° and 132° C. and at an optimum draw ratio. Lastly, the spinning speed and each of the foregoing conditions must be correlated to provide yarns having tenacities of at least 12 gpd. Under the foregoing conditions, the process can be carried out at commercially feasible spinning speed, for example, at spinning speeds of at least 30 m/min. and as high as 700 m/min. by using polyethylenes which in addition to having the above properties also have a $\bar{M}_w$ less than 125,000.

Heretofore, the $\bar{M}_n$ property of polyethylenes has not been considered to be particularly significant in obtaining fibers of high tensile strength. In the past, the property thought to be the most important in obtaining polyethylene fibers of high tensile strength was the $\bar{M}_w$ property. Also, heretofore, high temperature spinnerets have not to applicants' knowledge been used in producing high tenacity polyethylene yarns. It is believed that the use of the right polyethylene and a high temperature spinneret in combination with optimum hot-drawing conditions are essential for producing polyethylene yarns having a tenacity of at least 12 gpd.

The fibers of the invention are particularly useful as cordage, for example, rope and the like where breaking strength is of primary importance.

DETAILED DESCRIPTION OF THE PREFERRED EMBODIMENTS

The yarns of the present invention have a tenacity of at least 12 gpd and are produced by the above-described process. The process comprises extruding a certain polyethylene through a high temperature spinneret having at least one orifice to provide one or more molten streams, each of which is solidified in a quenching zone. The number of molten streams corresponds to the number of orifices in the spinneret. The resulting yarn is withdrawn from the quenching zone at a given velocity and subsequently hot-drawn at a temperature between 115° and 132° C. and at an optimum draw ratio. The conditions under which the process is carried out are correlated to produce yarns having a tenacity of at least 12 gpd at a spinning speed of at least 30 m/min. It will be understood that more than one process variable has an effect on the tenacity of the drawn yarn. The following discussion will consider the effect of changing only one of these variables while holding the other variables constant.

High density polyethylenes useful in carrying out the process must have a $\bar{M}_n$ of at least 20,000. When the $\bar{M}_n$ is less than 20,000, yarns having a tenacity of at least 12 gpd are not obtainable at commercially feasible speeds. Preferably, the polyethylenes have a density of 0.96 g/cm$^3$ or higher and the $\bar{M}_n$ is at least 22,000. In order to obtain high spinning speeds the polyethylenes must have a $\bar{M}_w$ less than about 125,000. As with other polymers, the melt viscosity of polyethylenes increases with increasing $\bar{M}_w$ values. Accordingly, the maximum possible spinning speed that may be used in carrying out the process is limited by the $\bar{M}_w$ value of the particular polyethylene employed and is inversely proportional to the $\bar{M}_w$ of the polyethylene. The spinning speed may be calculated by multiplying the velocity (V) of the molten polymer in the spinneret orifice and the jet stretch factor (JS), where JS is the amount of attenuation (or stretch) imparted to the molten streams between the spinneret and before their solidification in the quenching zone. The maximum spinning speed obtainable with a polyethylene of a given $\bar{M}_w$, where a yarn having a tenacity of at least 12 gpd is desired, is limited by both V and JS. V must not be so high as to cause melt fracture, a condition under which turbulence of the melt exists within the orifice and useful fibers can no longer be obtained. On the other hand, JS must not be so high that the tenacity of the drawn yarn is reduced to less than 12 gpd by reason thereof. Tenacity of the drawn fiber increases with increasing JS to a maximum value and thereafter rapidly decreases with increases in JS. Accordingly, for a polymer of a given $\bar{M}_w$ extruded at a given V, the tenacity of the drawn fiber can be maximized by selecting the appropriate spinning speed. While tenacity generally increases with increasing $\bar{M}_w$ within the range of 60,000 to 125,000, the $V_{max}$ and $JS_{max}$ values decrease with increasing $\bar{M}_w$ values. From experimental data in which conditions were selected to maximize tenacity the following formulas were derived to enable one to easily determine the maximum spinning speed ($SS_{max}$) and jet stretch factor ($JS_{max}$) that may be utilized in carrying out the process of this invention with a high density polyethylene of a given $\bar{M}_w$ between 60,000 and 125,000:

$$SS_{max} = 1858.4 - 2.7966\times10^{-2}\times\bar{M}_w + 1.6703\times10^{-7}\times(\bar{M}_w)^2 - 3.8969\times10^{-13}\times(\bar{M}_w)^3 \quad \text{(Formula 1)}$$

$$JS_{max} = 158.53 - 1.5387\times10^{-3}\times\bar{M}_w + 5.0393\times10^{-9}\times(\bar{M}_w)^2 - 6.6848\times10^{-15}\times(\bar{M}_w)^3 \quad \text{(Formula 2)}$$

In order to obtain yarns having a tenacity of 12 gpd, a high temperature spinneret must be used in carrying out the process. According to one embodiment of the invention, the molten polymer is extruded through a spinneret maintained at a temperature between about 220° and 335° C. into a quenching zone. At spinneret temperatures less than about 220° C., yarns having a tenacity of 12 gpd or higher are not obtainable and/or reasonable spinning speeds cannot be employed. On the other hand, the use of spinneret temperatures higher than about 335° C. causes degradation of the polymer and therefore are not desirable. According to another embodiment of the invention, a heated tube having an inside air temperature between 200° and 335° C. is positioned between the heated spinneret and the quenching zone. The tube is conveniently heated by electrical means and may be heated uniformly or different sections of the tube may be heated to different temperatures, for example, the upper half of the tube may be maintained at a higher or lower temperature than the lower half of the tube. Preferably, when a heated tube is employed, both the spinneret and heated tube are maintained at a temperature between 220° and 290° C. with a temperature between 260° and 280° C. being particularly preferred. While higher temperatures may be employed, such temperatures do not result in a significant increase in the tenacity of the drawn fiber. Although the use of a heated tube does not result in a significant increase in the tenacity of the drawn yarn, the use of such a tube facilitates spinning and packaging of the fibers. The heated tube normally may be positioned a short distance (e.g. 25 cm. or less) from the spinneret and may be 50 cm. to 1 meter or more in length.

The molten streams upon moving away from the spinneret or, when used, from the heated tube are solidified in a quenching zone. Preferably, quenching of the molten streams is assisted by exposing the molten streams to transverse flowing air in a conventional manner. The air is conventionally at ambient temperature and at a velocity so as not to cause turbulence of the streams and/or solidified fibers. The molten streams attenuate as they move away from the spinneret in an amount corresponding to the jet stretch factor (JS).

According to one embodiment of the invention, the solidified fiber is taken-up on a bobbin without drawing at a take-up speed (spinning speed) of at least 30 m/min. and preferably at least 50 m/min. This fiber is then used as the feed fiber in the hot-drawing step. Alternatively, the spinning and hot-drawing may be coupled, that is, carried out inline without intermediate take-up of the fiber.

In order to obtain yarns having a tenacity of at least 12 gpd, the process must be carried out under hot-drawing conditions which maximize the tenacity of the fiber. It has been found that the hot-drawing temperature (i.e. temperature of the heated environment) must be maintained at a temperature between about 115° and 132° C. if yarns having a tenacity of at least 12 gpd are to be obtained. Within this relatively narrow temperature range, the draw ratio is correlated with the particular temperature employed to obtain yarns having tenacities of at least 12 gpd. Normally, this draw ratio will be at least about 20:1. Fibers having the highest tenacity are produced when the hot-drawing temperature is between 124° and 132° C. and the draw ratio is at least 22:1. Normally, when the polyethylene fiber is hot-drawn at a given temperature between 115° and 132° C., the tenacity of the fiber increases with increasing draw ratio to a maximum value and thereafter remains substantially constant or decreases slightly with increasing draw ratio. It has been found that under most hot-drawing conditions this maximum tenacity value is obtained at a draw ratio ranging from about 20:1 to about 35:1 or higher. However, the modulus of the fiber continues to increase as the draw ratio increases beyond the draw ratio at which maximum tenacity is obtained. Accordingly, where the modulus of the fiber as well as the tenacity thereof is important, draw ratios higher than that required to obtain a fiber of maximum tenacity may benefically be employed. The hot-drawing of the fiber may be accomplished in a conventional manner, such as, by passing the fibers into contact with a heated environment maintained at a temperature between 115° and 132° C. while drawing the fiber at an optimum draw ratio. The heated environment may consist of a heated inert gas such as air or nitrogen or a heated metal surface (e.g. hot shoe) over which the yarn passes or a heated fluid such as hot ethylene glycol. Also, a heated metal block, rectangular in shape, having a slot running along a surface thereof through which the fiber passes without contacting to the extent possible any surfaces of the block may be suitably used. The hot-drawing of the fiber may be accomplished in a conventional manner such as by passing the fiber with several wraps around a first and then a second pair of driven rolls, where the first pair of rolls is positioned before the fiber contacts the heated environment and the second pair of rolls afterwards and where the peripheral speed of the first pair of rolls ($S_1$) and the peripheral speed ($S_2$) of the second pair of rolls are correlated to give a desired draw ratio ($S_2/S_1$=draw ratio). The fiber is then taken-up in a conventional manner such as on to a bobbin under slight tension to facilitate packaging.

The foregoing discussion has been given from the standpoint of maximizing tenacity and spinning speeds. It will be apparent to those skilled in the art that certain processing conditions may be varied over a wide range without departing from the scope of this invention, such as, the manner in which the molten streams are quenched or the fiber is taken-up or the particular heated environment employed.

The following examples are given to further illustrate the invention but are not intended to in any way limit the scope thereof.

In the examples, the tenacity (gpd), elongation (%) and modulus (gpd) are measured on yarns composed of at least 8 filaments at 72% relative humidity and 25° C. on an Instron Tester (Instron Engineering Corporation, Canton, Mass.) providing a constant extension rate of 120% per minute with a gauge length of 25 cm being used. All values given in the examples are based on the average of four tests (breaks). The measured denier of the fiber, test conditions and sample identifications are fed to a computer before the start of the test. The computer records the load-elongation curve of the fiber sample until the sample is broken and the calculates and records tenacity, elongation and modulus.

EXAMPLE 1

This example illustrates the product of polyethylene fiber of the present invention.

Polyethylene having a density of 0.96 g/cm$^3$, a $\bar{M}_w$ of 84,000 and a $\bar{M}_n$ of 25,200 was melted in a conventional melt extruder and extruded through an 8-hole spinneret at the rate of 2.4 g/min. to provide molten streams. Each hole (orifice) of the spinneret measured 9 mils (0.23 mm)×12 mils (0.30 mm) (diameter/length). The spinneret was maintained at a temperature of 240° C. A heated tube having an inside air temperature of 260° C. and measuring 24 inches (61 cm) in length was positioned about 4 inches (10.2 cm) below the spinneret. The molten streams passed through the heated tube and then through a quenching zone measuring about 1 m in length where the molten streams solidified to provide fibers. In the quenching zone the molten streams were exposed to transverse flowing air (ambient temperature) for a distance of about 1 m. The velocity of the flowing air was adjusted so as not to cause turbulence of the molten streams. From the quenching zone the fiber was passed into contact with an air turbine guide (partial wrap), then passed with 4 wraps around a pair of rolls rotating at a peripheral speed of 44 m/min., and finally were wound up on a bobbin at constant tension by means of a tension guide at the same speed (i.e. 44 m/min.). The resulting bobbin of yarn was used as the feed yarn in the drawing operation. In the drawing operation, the yarn was unwound from the bobbin and passed with 10 wraps around a pair of rolls rotating at a peripheral speed of about 11 ft. (3.4 m)/min. The yarn was then passed over a 16 inch (40.6 cm) hot block maintained at a temperature of 126.7° C., then with 10 wraps around a pair of rolls rotating at a peripheral speed of 282 ft. (86 m)/min. to give a draw ratio of 25.7, and finally taken up at constant tension on a bobbin at the same speed (282 ft/min.). The tenacity, elongation-to-break and modulus of the yarn were determined and found to be 13.7 gpd/5.02%/428 gpd, respectively.

EXAMPLES 2-12

These examples are given to illustrate additional sets of conditions which may be used in carrying out the process of this invention. Certain of the conditions were varied from example to example to illustrate the effect thereof on tenacity. In each example the conditions were correlated to maximize tenacity.

Yarns were prepared using the appartus, procedure and polyethylene described in Example 1. In each example air was used as the quench medium. In the hot-drawing step the draw ratio was varied from example to example by adjusting the peripheral speed of the pair of rotating rolls downstream from the hot block while maintaining the peripheral speed of the pair of rolls upstream from the hot block at 3.4 m/min. The tenacity, elongation and modulus of each yarn were determined and are given in Table 1 along with the processing conditions employed for each example including Example 1.

TABLE I

| EXAMPLE | 1 | 2 | 3 | 4 | 5 | 6 | 7 | 8 | 9 | 10 | 11 | 12 |
|---|---|---|---|---|---|---|---|---|---|---|---|---|
| Spinneret Temp. °C. | 240 | 240 | 260 | 220 | 260 | 260 | 220 | 260 | 260 | 280 | 280 | 280 |
| Hot Tube, Temp. °C. | 260 | 260 | 280 | 240 | 240 | 280 | 240 | 23 | 260 | 280 | 280 | 280 |
| Polym. Flow Rate g/min. | 2.4 | 2.4 | 2.4 | 2.4 | 2.4 | 2.4 | 2.4 | 2.4 | 2.4 | 5.0 | 5.0 | 7.8 |
| Spinning Speed m/min. | 44 | 75 | 101 | 101 | 101 | 44 | 44 | 75 | 75 | 150 | 75 | 75 |
| Hot Block, Temp. °C. | 126.7 | 128.9 | 127.8 | 127.3 | 127.8 | 127.8 | 127.6 | 127.7 | 127.7 | 128.7 | 128.2 | |
| Draw Ratio | 25.7 | 25.0 | 26.7 | 18.1 | 23.8 | 23.8 | 23.8 | 22.6 | 19.7 | 23.8 | 23.2 | 23.5 |
| Tenacity (gpd) | 13.7 | 15.17 | 15.57 | 5.43 | 13.1 | 13.5 | 12.3 | 12.95 | 12.67 | 16.70 | 13.10 | 13.6 |
| Elong. % | 5.02 | 5.23 | 5.10 | 7.35 | 5.64 | 5.20 | 3.91 | 6.24 | 7.10 | 4.60 | 5.94 | 5.08 |
| Modulus (gpd) | 428 | 513 | 590 | 86 | 303 | 316 | 337 | 399 | 272 | 581 | 300 | 546 |

The results shown in Table I illustrate the effect of various sets of correlated processing conditions on the tenacities of the drawn yarns. For instance, Examples 1 and 2; 3 and 6; and 4 and 7 illustrate the effect of spinning speed on tenacity. In Example 4 a draw ratio of greater than about 11.3 could not be used without breaking the yarn. The resulting yarn in this example had a tenacity of only 5.43 gpd. In Example 7 the spinning speed was reduced from 101 to 44 m/min. which permitted the use of a higher draw ratio (i.e. 23.8:1) whereby a yarn having a tenacity of 12.3 gpd was obtained. As shown by Examples 3 and 10, yarns of the highest tenacity were obtained when the spinneret was maintained at 260° or 280° C.

EXAMPLE 13

This example illustrates the production of a monofilament polyethylene fiber having a yarn tenacity of 13.99 gpd, an elongation-to-break of 5.49% and a modulus of 499 gpd (8 of the monofilaments were combined in the testing thereof).

In this instance, the polyethylene described in Example 1 was extruded through a spinneret having a single orifice measuring 25 mils (0.6 mm)×50 mils (1.2 mm) (diameter/length). The apparatus (except for the spinneret) and procedure described in Example 1 was employed under the following set of conditions:

spinneret temperature—266° C.
hot tube (length/temperature)—24 inches (61 cm)/125° C.
quench medium—air
polymer flow rate—1.58 g/min.
spinning speed—342 m/min.
hot-draw (temperature/draw ratio)—126.8° C./23.18

EXAMPLES 14–32

In these examples yarns were produced using the apparatus and procedure described in Examples 1–12 with the exception that in this instance the polyethylene had a $\bar{M}_n$ of 28,000, a $\bar{M}_w$ of 115,000 and a density of 0.96. The processing conditions were varied from example to example to demonstrate the effect thereof on the tenacity of the drawn yarns. The set of conditions used in each example is given in Table II. As in Examples 1–12, an 8-hole spinneret, each hole measuring 0.23 mm×0.30 mm (diameter/length), was employed in each example.

TABLE II

| EXAMPLE | 14 | 15 | 16 | 17 | 18 | 19 | 20 | 21 | 22 | 23 | 24 |
|---|---|---|---|---|---|---|---|---|---|---|---|
| Spinneret Temp. °C. | 300 | 280 | 299 | 275 | 275 | 325 | 300 | 300 | 300 | 325 | 275 |
| Hot Tube, Temp. °C. | 270 | 280 | 23 | 220 | 220 | 220 | 245 | 245 | 245 | 270 | 270 |
| Polym. Flow Rate g/min. | 2.4 | 2.4 | 2.35 | 2.35 | 2.35 | 2.35 | 2.35 | 2.35 | 2.35 | 2.35 | 2.35 |
| Spinning Speed m/min. | 200 | 50 | 60 | 45 | 75 | 45 | 30 | 90 | 60 | 45 | 45 |
| Hot Block, Temp. °C. | 125.6 | 128.8 | 127.7 | 127.5 | 127.1 | 127.7 | 127.8 | 127.8 | 127.9 | 127.6 | 127.4 |
| Draw Ratio | 26.0 | 26.4 | 27.20 | 22.9 | 26.6 | 22.9 | 22.6 | 22.6 | 26.1 | 21.3 | 20.6 |
| Tenacity (gpd) | 14.30 | 14.97 | 15.16 | 14.0 | 15.92 | 13.16 | 13.4 | 14.16 | 14.27 | 12.48 | 13.25 |
| Elong. % | 5.07 | 4.76 | 4.69 | 5.77 | 4.69 | 5.93 | 5.98 | 5.19 | 4.55 | 6.39 | 6.21 |
| Modulus (gpd) | 902 | 1043 | 831 | 759 | 1145 | 660 | 691 | 790 | 894 | 623 | 619 |

| EXAMPLE | 25 | 26 | 27 | 28 | 29 | 30 | 31 | 32 |
|---|---|---|---|---|---|---|---|---|
| Spinneret Temp. °C. | 325 | 300 | 300 | 300 | 300 | 300 | 300 | 300 |
| Hot Tube, Temp. °C. | 270 | 23 | 270 | 270 | 270 | 270 | 270 | 270 |
| Polym. Flow Rate g/min. | 2.35 | 4.8 | 4.8 | 4.8 | 4.8 | 4.8 | 4.8 | 4.8 |
| Spinning Speed m/min. | 75 | 45 | 60 | 90 | 90 | 105 | 120 | 158 |
| Hot Block, Temp. °C. | 127.9 | 127.0 | 127.8 | 128.5 | 128.5 | 127.8 | 127.0 | 127.0 |
| Draw Ratio | 20.6 | 23.5 | 22.1 | 31.8 | 31.7 | 19.2 | 22.6 | 16.7 |
| Tenacity (gpd) | 12.33 | 13.59 | 13.11 | 17.24 | 19.38 | 12.72 | 13.85 | 13.71 |
| Elong. % | 5.25 | 5.79 | 5.75 | 3.70 | 3.86 | 6.83 | 5.65 | 6.93 |
| Modulus (gpd) | 626 | 754.8 | 642 | 826 | 854 | 564 | 747 | 554 |

The tenacities of the yarns illustrated in Table II tend to be higher than those shown in Table I. This indicates that as the $\bar{M}_n$ value of the polyethylene increases, the tenacities of the drawn yarns also increases. The yarns shown in Tables I and II were prepared from polyethylenes having $\bar{M}_n$ values of 25,200 and 28,000, respectively.

EXAMPLES 33–55

These examples illustrate the importance of utilizing a polyethylene having a $\overline{M}_n$ of at least 20,000. In these examples a polyethylene having a $\overline{M}_n$ of 13,100, a $\overline{M}_w$ of 86,700 and a density of 0.964 was melt spun into fiber using the apparatus and procedure described in Example 1. The processing conditions were varied from example to example in an effort to produce a yarn having a tenacity of 12 gpd or higher. In no instance could such a yarn be produced. The conditions used in each of the examples are given in Table III. In each instance a spinneret having six orifices each measuring 9 mils (0.23 mm)×12 mils (0.30 mm) (diameter/length) was employed.

TABLE III

| EXAMPLE | 33 | 34 | 35 | 36 | 37 | 38 | 39 | 40 | 41 | 42 | 43 | 44 |
|---|---|---|---|---|---|---|---|---|---|---|---|---|
| Spinneret Temp. °C. | 294 | 294 | 275 | 275 | 325 | 325 | 251 | 300 | 298 | 298 | 325 | 275 |
| Hot Tube, Temp. °C. | 23 | 23 | 220 | 220 | 220 | 220 | 245 | 245 | 245 | 245 | 270 | 270 |
| Polym. Flow Rate g/min. | 2.6 | 2.6 | 2.6 | 2.6 | 2.6 | 2.6 | 2.6 | 2.6 | 2.6 | 2.6 | 2.6 | 2.6 |
| Spinning Speed m/min. | 60 | 80 | 60 | 100 | 60 | 100 | 80 | 40 | 120 | 80 | 60 | 60 |
| Hot Block, Temp. °C. | 124.1 | 124.0 | 125.0 | 125.0 | 125.0 | 125.0 | 125.0 | 125.0 | 125.0 | 123 | 123.4 | 123.4 |
| Draw Ratio | 20.86 | 20.86 | 20.86 | 17.62 | 22.25 | 21.33 | 12.98 | 22.56 | 14.68 | 19.78 | 22.87 | 22.41 |
| Tenacity (gpd) | 8.99 | 10.43 | 10.12 | 8.82 | 10.0 | 9.58 | 7.62 | 9.74 | 7.77 | 9.51 | 9.15 | 10.32 |
| Elong. % | 5.45 | 5.78 | 6.03 | 6.40 | 5.69 | 5.35 | 9.14 | 5.43 | 7.79 | 6.16 | 5.15 | 5.80 |
| Modulus (gpd) | 289 | 301 | 293 | 232 | 299 | 307 | 149 | 301 | 162 | 264 | 294 | 319 |

| EXAMPLE | 45 | 46 | 47 | 48 | 49 | 50 | 51 | 52 | 53 | 54 | 55 |
|---|---|---|---|---|---|---|---|---|---|---|---|
| Spinneret Temp. °C. | 275 | 325 | 300 | 300 | 298 | 300 | 300 | 300 | 300 | 300 | 300 |
| Hot Tube, Temp. °C. | 270 | 270 | 23 | 270 | 270 | 270 | 270 | 270 | 270 | 270 | 23 |
| Polym. Flow Rate g/min. | 2.6 | 2.6 | 4.7 | 4.7 | 4.7 | 4.7 | 4.7 | 4.7 | 4.7 | 4.7 | 4.7 |
| Spinning Speed m/min. | 100 | 100 | 60 | 60 | 80 | 100 | 120 | 140 | 160 | 207 | 120 |
| Hot Block, Temp. °C. | 124.7 | 124.6 | 126.2 | 125.7 | 124.1 | 125.8 | 125.6 | 125.6 | 125.8 | 124.7 | 124.9 |
| Draw Ratio | 20.1 | 16.7 | 21.8 | 23.2 | 24.1 | 21.5 | 20.0 | 16.5 | 19.5 | 12.7 | 18.2 |
| Tenacity (gpd) | 9.17 | 8.05 | 9.14 | 10.95 | 10.68 | 10.54 | 10.33 | 9.36 | 10.13 | 7.40 | 9.55 |
| Elong. % | 5.37 | 6.88 | 5.82 | 5.65 | 5.19 | 6.13 | 5.83 | 8.10 | 6.22 | 9.78 | 6.57 |
| Modulus (gpd) | 283 | 220 | | | | | | | | | |

The results in Table III show that it is essential to obtaining yarn having a tenacity of at least 12 gpd that the process be carried out using a high density polyethylene having a $\overline{M}_n$ of at least 20,000. It will be appreciated that the polyethylene used in the instant examples has an $\overline{M}_w$ of 86,700 which is higher than the $\overline{M}_w$ of the polyethylene used in Examples 1–13 ($\overline{M}_w$ of 84,000), wherein yarns having a tenacity of 12 or more gpd were obtained.

EXAMPLE 56

Based on the results obtained in Examples 33–55 a further experiment was carried out to determine, if under optimum conditions, a yarn having a tenacity of 12 or more gpd could be obtained at some draw ratio between 20:1 and 30:1.

In this experiment two as-spun yarns were prepared from the polyethylene described in Examples 33–55 under optimum spinning conditions. Samples of each of the as-spun yarns were then hot-drawn at different draw ratios increasing from about 20:1 until a draw ratio of about 30:1 was obtained at an optimum hot-drawing temperature (124°–125° C.) in an effort to provide a yarn having a tenacity of 12 gpd or higher.

The as-spun yarns were prepared using the apparatus and procedure described in Examples 33–55 under the following conditions:

spinneret temperature—299°±1° C.
hot tube (length/temperature)—24 inches/270° C.
quenching medium—air
polymer flow rate—4.7 g/min.

The as-spun yarns were then hot-drawn using the apparatus and procedure described in Examples 33–55. In the hot-drawing operation each yarn sample was withdrawn from the feed bobbin at 11 ft. (3.4 m)/min., passed over the 16 inch-hot block and collected at a speed so as to give the draw ratios shown in the following table. The hot block was maintained at a temperature of 124°–125° C. This temperature was selected as being the optimum hot-drawing temperature under the conditions of this experiment. The tenacity, elongation and modulus of each yarn sample were determined and are also given in the table.

TABLE IV

| Fiber | Draw Ratio | Tenacity (gpd) | Elong. % | Modulus (gpd) |
|---|---|---|---|---|
| 1 | 23.18 | 10.95 | 5.65 | 344 |
| | 23.71 | 10.09 | 5.22 | 341 |
| | 25.5 | 10.23 | 5.11 | 353 |
| | 25.5 | 9.47 | 4.55 | 348 |
| | 26.1 | 9.26 | 4.44 | 350 |
| | 26.27 | 8.17 | 3.60 | 419 |
| | 27.19 | 10.52 | 4.29 | 409 |
| 2 | 19.94 | 9.76 | 6.76 | 259 |
| | 22.1 | 10.12 | 5.80 | 303 |
| | 23.18 | 10.38 | 5.70 | 320 |
| | 24.11 | 10.68 | 5.19 | 357 |
| | 26.12 | 10.96 | 4.92 | 389 |
| | 28.68 | 10.34 | 3.78 | 452 |
| | 30.6 | 10.59 | 3.79 | 483 |

The results of this example further demonstrates the necessity of using a polyethylene having a $\overline{M}_n$ of at least 20,000 if yarns having a tenacity of at least 12 gpd are to be obtained. While $\overline{M}_w$ is important with regard to spinning speeds and has some effect on tenacity, the results of this example and the previous examples clearly demonstrate that employing polyethylenes having a $\overline{M}_n$ of at least 20,000 is essential in obtaining fibers of 12 or more gpd regardless of the $\overline{M}_w$ value of the polyethylene.

EXAMPLE 57

This example illustrates carrying out the process of this invention at relatively high drawing speeds.

In the example as as-spun yarn was prepared under the same spinning conditions described in Example 16 using an eight-hole spinneret, each hold measuring 9 mils (3.4 mm)×10 mils (2.54 mm). Samples of the as-spun yarn were hot-drawn using the apparatus and procedure described in Example 1 under the following conditions given in Table V, wherein $S_1$ represents the speed of the pair of rolls upstream from the hot block and $S_2$ represents the speed of the pair of rolls downstream from the hot block (drawing speed):

TABLE V

| Yarn Sample # | $S_1$ m/min. | $S_2$ m/min. | Draw Ratio to 1 | Hot Block Temp. °C. | Tenacity gpd | Elong. % | Modulus gpd |
|---|---|---|---|---|---|---|---|
| 1 | 6.7 | 191.7 | 28.6 | 127.1 | 14.5 | 3.77 | 663 |
| 2 | 9.1 | 228.9 | 25.0 | 127.1 | 14.4 | 4.38 | 578 |
| 3 | 10.8 | 274.0 | 25.3 | 127.1 | 15.7 | 3.77 | 691 |

The results in Table V show that the hot-drawing step may be carried out a relatively high drawing speeds. The drawing speed was limited in this example only by virtue that the winder was not capable of running at take-up speeds higher than 274 m/min. Based on the experiment of this example, it is believed that drawing speeds considerably higher than 500 m/min. could be successfully utilized. Thus, the process can be carried out using commercially feasible spinning and drawing speeds whereby the spinning and drawing could be accomplished inline without intermediate take-up of the yarn.

We claim:

1. A process for preparing a polyethylene fiber having a tenacity of at least 12 grams per denier, comprising:

a. extruding a high density polyethylene having a $\bar{M}_n$ of at least 20,000 and a $\bar{M}_w$ of less than 125,000 through a heated spinneret having at least one orifice to provide at least one molten stream, wherein said heated spinneret is maintained at a temperature between 220° and about 335° C.;

b. solidifying each said molten stream in a quenching zone to form a fiber;

c. withdrawing said fiber from said quenching zone at a velocity of at least 30 meters per minute, and then d. hot-drawing said fiber at a draw ratio of at least 20:1 while said fiber is in contact with a heated environment, wherein said heated environment is maintained at a temperature between 115° and 132° C., said temperatures, said velocity, and said draw ratio being correlated to provide fiber having a tenacity of at least 12 grams per denier, when measured at 72% relative humidity and 25° C. on a bundle of at least 8 filaments using a gauge length of at least 25 centimeters.

2. The process of claim 1 wherein said spinneret is maintained at a temperature between about 240° and 335° C.

3. The process of claim 2 wherein said heated environment is maintained at a temperature between 124° and 132° C.

4. The process of claim 3 wherein said polyethylene has a $\bar{M}_n$ of at least 22,000.

5. The process of claim 1 wherein said fiber is withdrawn from said quenching zone at a velocity of at least 50 meters per minute.

6. The process of claim 1 wherein said fiber is withdrawn from said quenching zone at a velocity of at least 100 meters per minute.

7. The process of claim 1 wherein said heated environment consists of a heated metal or ceramic block.

8. The process of claim 1 wherein said at least one molten stream passes through a heated tube maintained at a temperature between about 200° and about 335° C. and positioned between said spinneret and said quenching zone at a distance of 25 centimeters or less from said spinneret.

9. The process of claim 8 wherein said spinneret and said heated tube are both maintained at a temperature between about 260° and about 280° C.

10. The process of claim 1 wherein said spinneret has one orifice.

11. The process of claim 1 wherein said spinneret has a plurality of orifices.

12. The process of claim 1 wherein the velocity of said fiber after being hot-drawn is at least about 250 meters per minute.

13. The process of claim 1 wherein the hot-drawing step is accomplished inline without intermediate take-up of the fiber.

14. The process of claim 1 wherein the hot-drawing step is accomplished by an operation separate from that of extruding and solidifying said polyethylene.

15. The process of claim 1 wherein said polyethylene has a density of at least 0.96 grams per cubic centimeter.

* * * * *